US009260930B2

(12) United States Patent
Smith et al.

(10) Patent No.: US 9,260,930 B2
(45) **Date of Patent: *Feb. 16, 2016**

(54) PRESSURE TESTING VALVE AND METHOD OF USING THE SAME

(75) Inventors: Donald Smith, Wilson, OK (US); Kendall L. Pacey, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 637 days.

This patent is subject to a terminal disclaimer.

(21) Appl. No.: 13/599,044

(22) Filed: Aug. 30, 2012

(65) Prior Publication Data

US 2014/0060852 A1 Mar. 6, 2014

(51) Int. Cl.

| | |
|---|---|
| ***E21B 34/14*** | (2006.01) |
| ***E21B 23/04*** | (2006.01) |
| ***E21B 34/10*** | (2006.01) |
| ***E21B 34/06*** | (2006.01) |
| *E21B 34/00* | (2006.01) |

(52) U.S. Cl.

CPC ..... *E21B 23/04* (2013.01); *E21B 34/06* (2013.01); *E21B 34/103* (2013.01); *E21B 34/14* (2013.01); *E21B 2034/007* (2013.01)

(58) Field of Classification Search

USPC ..... 166/374, 332.1, 373, 321

See application file for complete search history.

(56) References Cited

U.S. PATENT DOCUMENTS

| | | | | |
|---|---|---|---|---|
| 4,627,492 | A * | 12/1986 | MacLaughlin | 166/250.08 |
| 5,404,956 | A | 4/1995 | Bohlen et al. | |
| 6,491,116 | B2 | 12/2002 | Berscheidt et al. | |
| 6,695,050 | B2 | 2/2004 | Winslow et al. | |
| 6,695,051 | B2 | 2/2004 | Smith et al. | |
| 6,976,534 | B2 | 12/2005 | Sutton et al. | |
| 7,195,067 | B2 | 3/2007 | Manke et al. | |
| 7,337,852 | B2 | 3/2008 | Manke et al. | |
| 7,373,973 | B2 | 5/2008 | Smith et al. | |
| 7,510,017 | B2 | 3/2009 | Howell et al. | |
| 7,559,363 | B2 | 7/2009 | Howell et al. | |
| 7,617,871 | B2 | 11/2009 | Surjaatmadja et al. | |
| 7,673,673 | B2 | 3/2010 | Surjaatmadja et al. | |

(Continued)

OTHER PUBLICATIONS

Filing receipt and specification for patent application entitled "Pressure Testing Valve and Method of Using the Same," by Matthew Todd Howell, et al., filed Jan. 22, 2013 as U.S. Appl. No. 13/746,957.

(Continued)

*Primary Examiner* — Taras P Bemko

(74) *Attorney, Agent, or Firm* — John W. Wustenberg; Baker Botts L.L.P.

(57) ABSTRACT

A wellbore system suitable for conducting pressure testing of wellbore equipment. The system comprises a casing and a pressure testing valve incorporated within the casing. The pressure testing valve further comprises a sleeve positioned within a housing and transitional from a first to a second position, and from the second to a third position. When the sleeve is in the first and second positions, the sleeve blocks a route of fluid communication via one or more housing ports. When the sleeve is in the third position the sleeve does not block fluid communication. The pressure testing valve is configured such that the sleeve transitions from the first position to the second position when a force in the direction of the second position is applied to the sleeve. When in the second position, a reduction of the force in the direction of the second position to the sleeve causes the sleeve to transition to the third position.

16 Claims, 5 Drawing Sheets

(56) References Cited

U.S. PATENT DOCUMENTS

| | | | | |
|---|---|---|---|---|
| 7,878,255 | B2 | 2/2011 | Howell et al. | |
| 7,946,340 | B2 | 5/2011 | Surjaatmadja et al. | |
| 7,963,331 | B2 | 6/2011 | Surjaatmadja et al. | |
| 8,146,673 | B2 | 4/2012 | Howell et al. | |
| 8,215,404 | B2 | 7/2012 | Makowiecki et al. | |
| 2008/0135248 | A1 | 6/2008 | Talley et al. | |
| 2009/0308588 | A1 | 12/2009 | Howell et al. | |
| 2011/0036590 | A1* | 2/2011 | Williamson et al. | 166/373 |
| 2011/0042107 | A1* | 2/2011 | Chambers et al. | 166/386 |
| 2011/0253383 | A1 | 10/2011 | Porter et al. | |
| 2012/0205120 | A1 | 8/2012 | Howell | |
| 2012/0205121 | A1 | 8/2012 | Porter et al. | |

OTHER PUBLICATIONS

Filing receipt and specification for patent application entitled "Pressure Testing Valve and Method of Using the Same," by Matthew Todd Howell, et al., filed Jan. 22, 2013 as U.S. Appl. No. 13/747,100.

* cited by examiner

PRESSURE TESTING VALVE AND METHOD OF USING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

When wellbores are prepared for oil and gas production, it is common to cement a casing string within the wellbore. Often, it may be desirable to cement the casing within the wellbore in multiple, separate stages. Furthermore, stimulation equipment may be incorporated within the casing string for use in the overall production process. The casing and stimulation equipment may be run into the wellbore to a predetermined depth. Various "zones" in the subterranean formation may be isolated via the operation of one or more packers, which may also help to secure the casing string and stimulation equipment in place, and/or via cement.

Following placement of the casing string and stimulation equipment within the wellbore, it may be desirable to "pressure test" the casing string and stimulation equipment, to ensure the integrity of both, for example, to ensure that a hole or leak has not developed during placement of the casing string and stimulation equipment. Pressure-testing generally involves pumping a fluid into an axial flowbore of the casing string such that a pressure is internally applied to the casing string and the stimulation equipment and maintaining that hydraulic pressure for sufficient period of time to ensure the integrity of both, for example, to ensure that a hole or leak has not developed. To accomplish this, no fluid pathway out of the casing string can be open, for example, all ports or windows of the fracturing equipment, as well as any additional routes of fluid communication, must be closed or restricted.

Following the pressure test, it may be desirable to provide at least one route of fluid communication out of the casing string. Conventionally, the methods and/or tools employed to provide fluid pathways out of the casing string after the performance of a pressure test are configured to open upon exceeding the pressure levels achieved during pressure testing, thereby limiting the pressures that may be achieved during that pressure test. Such excessive pressure levels required to open the casing string may jeopardize the structural integrity of the casing string and/or stimulation equipment, for example, by requiring that the casing and/or various other wellbore servicing equipment components be subjected to pressures near or in excess of the pressures for which such casing string and/or wellbore servicing component may be rated. Thus, a need exists for improved pressure testing valves and methods of using the same.

SUMMARY

Disclosed herein is a wellbore servicing system comprising a casing string, and a pressure testing valve, the pressure testing valve incorporated within the casing string and comprising a housing comprising one or more ports and an axial flowbore, and a sliding sleeve, wherein the sliding sleeve is slidably positioned within the housing and transitional from a first position to a second position, and from the second position to a third position, wherein, when the sliding sleeve is in the first position and the second position, the sliding sleeve blocks a route of fluid communication via the one or more ports and, when the sliding sleeve is in the third position the sliding sleeve does not block the route of fluid communication via the one or more ports, wherein the pressure testing valve is configured such that application of a force in the direction of the second position to the sliding sleeve causes the sliding sleeve to transition from the first position to the second position, and wherein the pressure testing valve is configured such that a reduction of the force in the direction of the second position applied to the sliding sleeve causes the sliding sleeve to transition from the second position to the third position.

Also disclosed herein is a wellbore servicing method comprising positioning casing string having a pressure testing valve incorporated therein within a wellbore penetrating the subterranean formation, wherein the pressure testing valve comprises a housing comprising one or more ports and an axial flowbore; and a sliding sleeve, wherein the sliding sleeve is slidably positioned within the housing, wherein the sliding sleeve is configured to block a route of fluid communication via one or more ports when the casing string is positioned within the wellbore, applying a fluid pressure of at least an upper threshold to the axial flowbore, wherein, upon application of the fluid pressure of at least the upper threshold, the sliding sleeve continues to block the route of fluid communication, and reducing the fluid pressure to not more than a lower threshold, wherein, upon reduction of the fluid pressure to not more than the lower threshold, the sliding sleeve allows fluid communication via one or more ports of the housing.

Further disclosed herein is a wellbore servicing method comprising positioning casing string having a pressure testing valve incorporated therein within a wellbore penetrating the subterranean formation, pressurizing an axial flowbore of the casing string, wherein the pressure within the axial flowbore reaches at least an upper threshold, maintaining the pressure within the axial flowbore for a predetermined duration, allowing the pressure within the axial flowbore to subside to not more than a lower threshold, wherein, upon allowing the pressure within the axial flowbore to subside to not more than the lower threshold, the pressure testing valve opens.

Further disclosed herein is a wellbore servicing method comprising pressure testing at a first pressure a tubing string positioned within a wellbore penetrating a subterranean formation, reducing pressure within the tubing string to a second pressure that is less than the first pressure, wherein the reduction in pressure opens a fluid pathway between an interior of the tubing string and the wellbore, and flowing a fluid down the tubing string, through the fluid pathway, and into the wellbore or subterranean formation.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
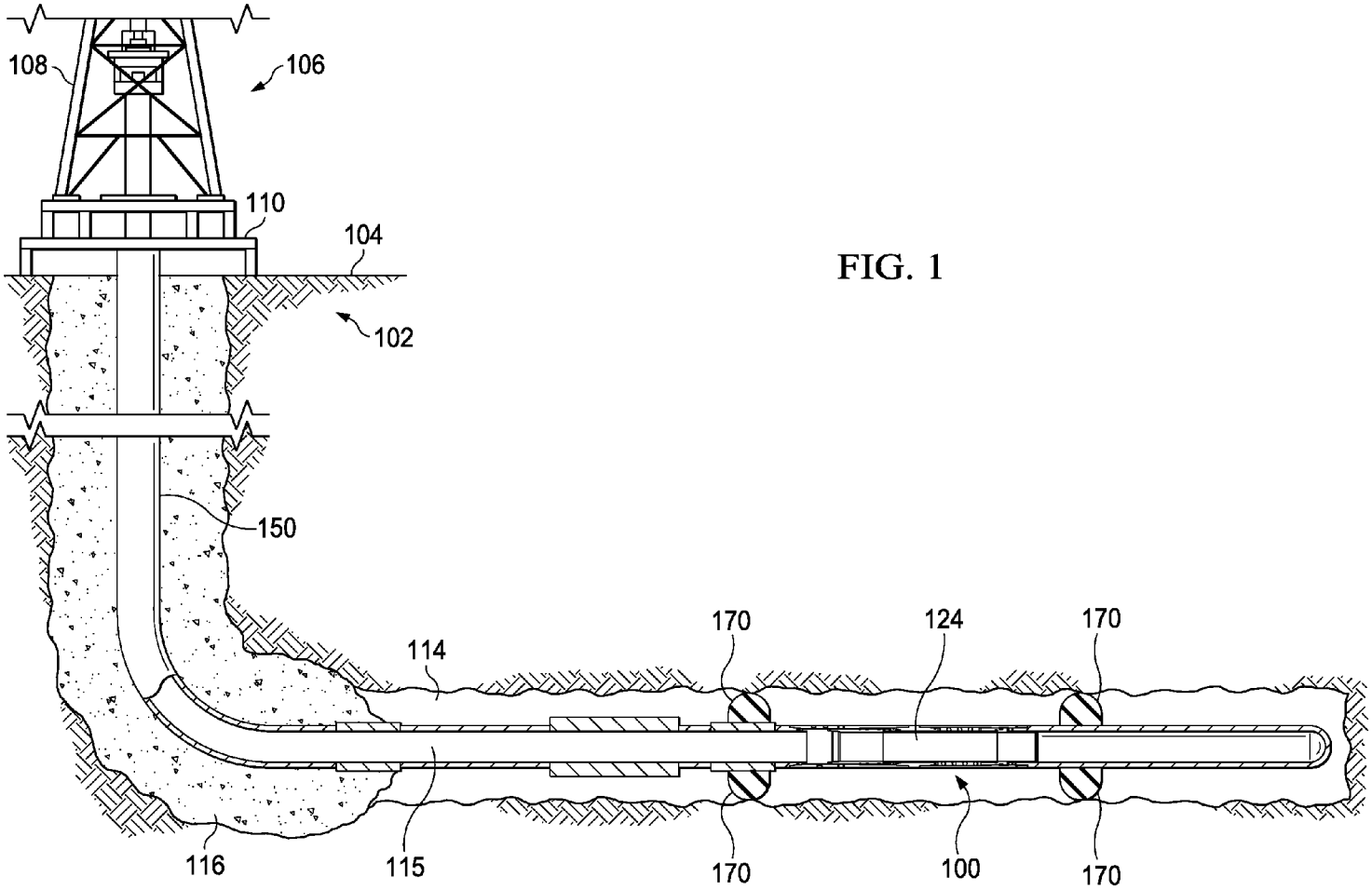
FIG. 1 is a partial cut-away view of an operating environment of a pressure testing valve depicting a wellbore penetrating a subterranean formation and a casing string having a pressure testing valve incorporated therein and positioned within the wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of a pressure testing valve (PTV) and method of using the same. Particularly, disclosed herein are one or more embodiments of a PTV incorporated within a tubular, for example a casing string or liner, comprising one or more wellbore servicing tools positioned within a wellbore penetrating subterranean formation.

Where a casing string has been placed within a wellbore and, for example, prior to the commencement of stimulation (e.g., fracturing and/or perforating) operations, it may be desirable to pressure test the casing string or liner and thereby verify its integrity and functionality. In the embodiments disclosed herein, a PTV enables the casing string to be pressure tested and subsequently allow a route of fluid communication from a flowbore of the casing string to the wellbore without the use of excessive pressure threshold levels.

Referring to FIG. 1, an embodiment of an operating environment in which such a PTV may be employed is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1, the operating environment comprises a drilling or servicing rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 by any suitable drilling technique. In an embodiment, the drilling or servicing rig 106 comprises a derrick 108 with a rig floor 110 through which a casing string 150 generally defining an axial flowbore 115 may be positioned within the wellbore 114. The drilling or servicing rig 106 may be conventional and may comprise a motor driven winch and other associated equipment for lowering the casing string 150 into the wellbore 114 and, for example, so as to position the PTV 100 and/or other wellbore servicing equipment at the desired depth.

In an embodiment the wellbore 114 may extend substantially vertically away from the earth's surface 104 over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In an embodiment, a portion of the casing string 150 may be secured into position against the formation 102 in a conventional manner using cement 116. In alternative embodiment, the wellbore 114 may be partially cased and cemented thereby resulting in a portion of the wellbore 114 being uncemented. In an embodiment, incorporated within the casing string 150 is a PTV 100 or some part thereof. The PTV 100 may be delivered to a predetermined depth within the wellbore. In an alternative embodiment, the PTV 100 or some part thereof may be comprised along and/or integral with a liner.

It is noted that although the PTV is disclosed as being incorporated within a casing string in one or more embodiments, the specification should not be construed as so-limiting. A wellbore servicing tool may similarly be incorporated within other suitable tubulars such as a work string, liner, production string, a length of tubing, or the like.

Referring to FIG. 1, the casing string 150 and/or PTV 100 may additionally or alternatively be secured within the wellbore 114 using one or more packers 170. The packer 170 may generally comprise a device or apparatus which is configurable to seal or isolate two or more depths in a wellbore from each other by providing a barrier concentrically about a casing string and therebetween. Non-limiting examples of a packer suitably employed as packer 170 include a mechanical packer or a swellable packer (for example, SwellPackers™, commercially available from Halliburton Energy Services).

While the operating environment depicted in FIG. 1 refers to a stationary drilling or servicing rig 106 for lowering and setting the casing string 150 within a land-based wellbore 114, one of ordinary skill in the art will readily appreciate that mobile workover rigs, wellbore servicing units (e.g., coiled tubing units), and the like may be used to lower the casing string 150 into the wellbore 114. It should be understood that a PTV may be employed within other operational environments, such as within an offshore wellbore operational environment.

Figure 4A:
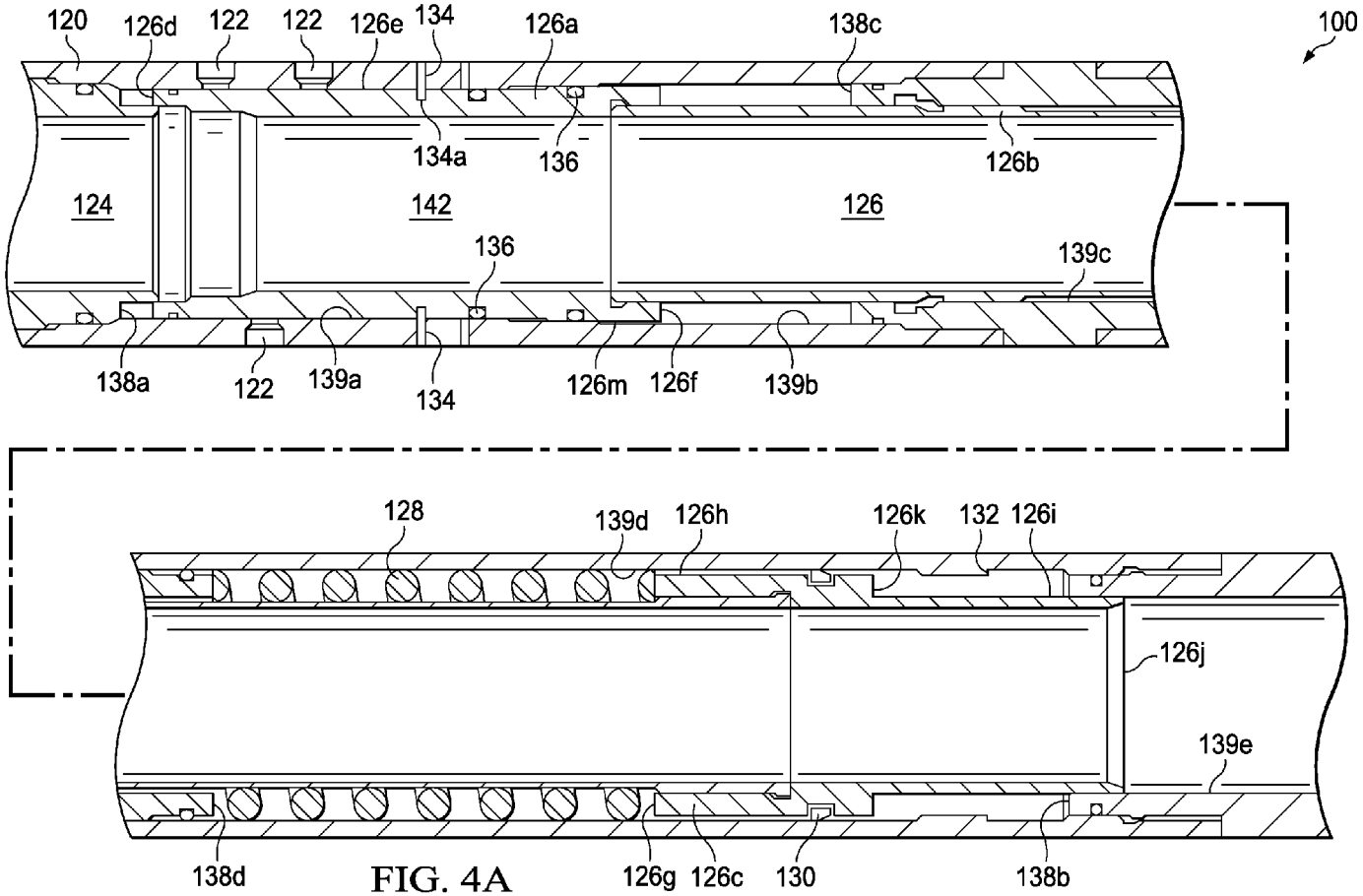
FIG. 4A is partial cut-away view of an embodiment of a pressure testing valve in a first configuration.
Figure 4B:
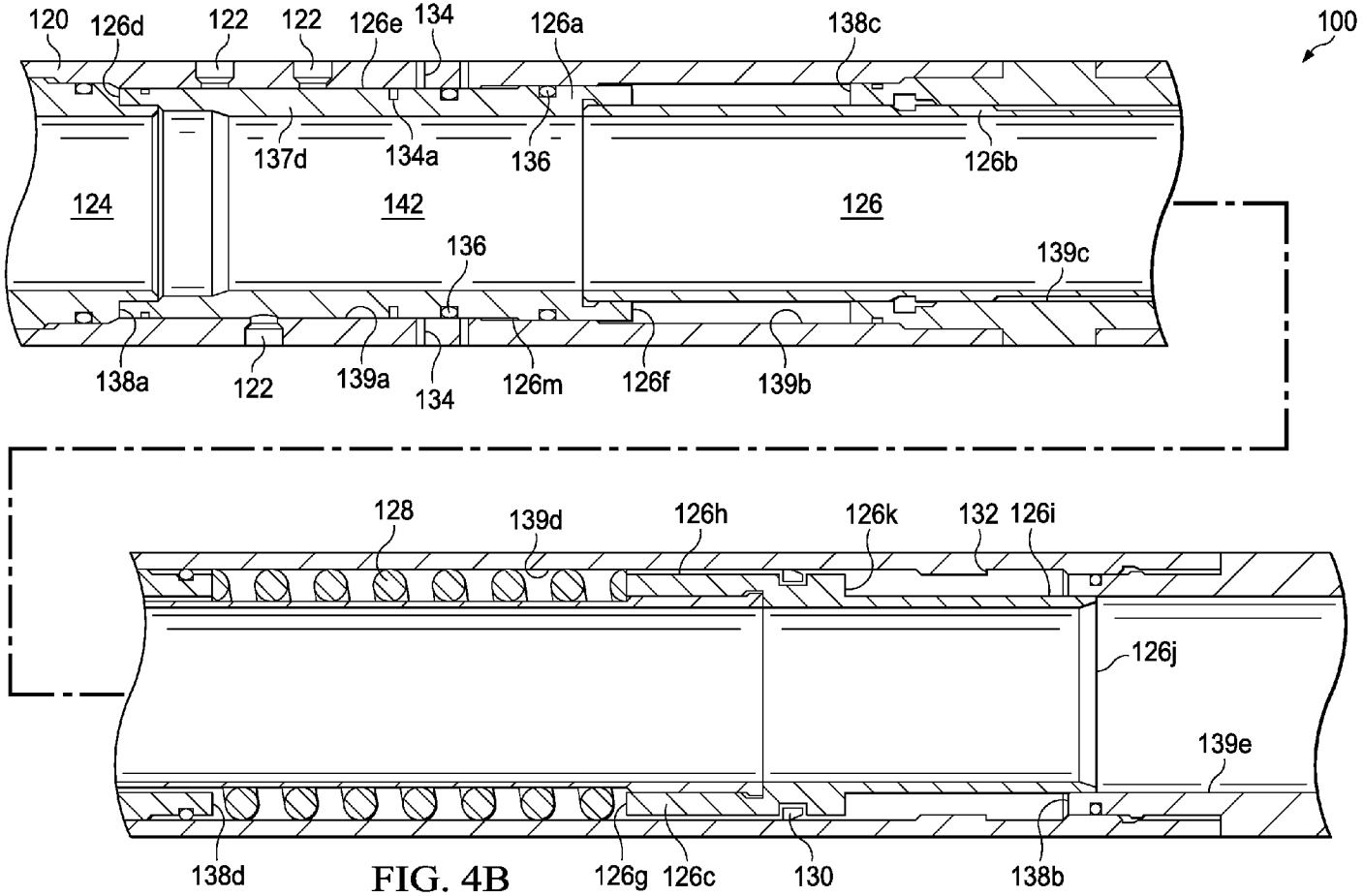
FIG. 4B is partial cut-away view of an embodiment of a pressure testing valve in a second configuration.
Figure 4C:
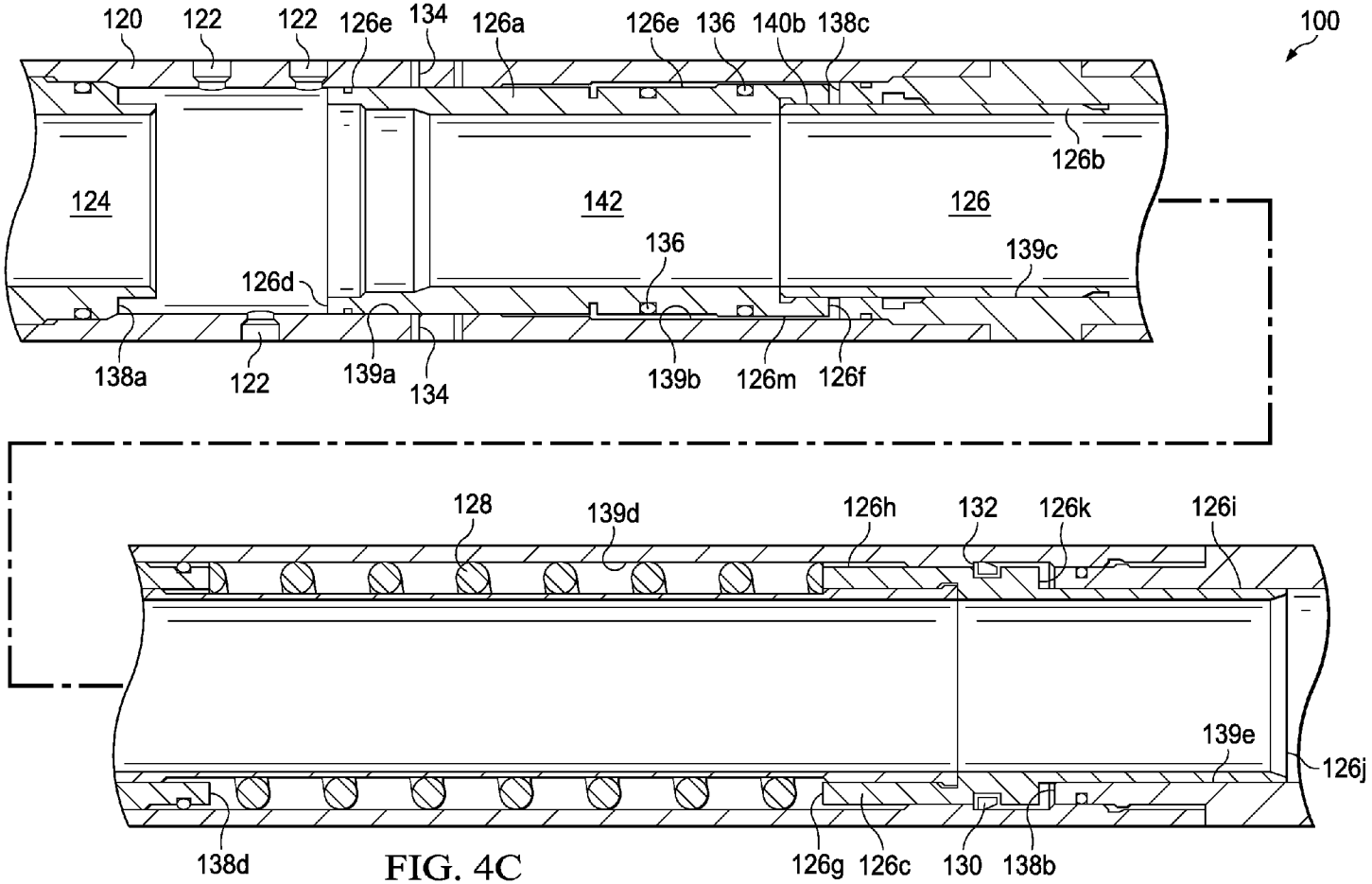
FIG. 4C is partial cut-away view of an embodiment of a pressure testing valve in a third configuration.

In an embodiment, the PTV 100 is selectively configurable to either allow or disallow a route of fluid communication from a flowbore 124 thereof and/or the casing flowbore 115 to the formation 102 and/or into the wellbore 114. Referring to FIGS. 4A-4C, in an embodiment, the PTV 100 may generally comprise of a housing 120, a sliding sleeve 126, and one or more ports 122. In an embodiment, the PTV 100 may be configured to be transitional from a first configuration to a second configuration and from the second configuration to a third configuration.

In an embodiment as depicted in FIG. 4A, the PTV 100 is illustrated in the first configuration. In the first configuration, the PTV 100 is configured to disallow fluid communication via the one or more ports 122 of the PTV 100. Additionally, in an embodiment, when the PTV 100 is in the first configuration, the sliding sleeve 126 is located (e.g., immobilized) in a first position within the PTV 100, as will be disclosed herein.

In an embodiment as depicted in FIG. 4B, the PTV 100 is illustrated in the second configuration. In the second configuration, the PTV 100 is configured to disallow fluid communication via the one or more ports 122 of the PTV 100. In an embodiment as will be disclosed herein, the PTV 100 may be configured to transition from the first configuration to the second configuration upon the application of a pressure to the PTV 100 of at least a first or upper pressure threshold. Additionally, in an embodiment when the PTV 100 is in the second configuration, the sliding sleeve 126 is in a second position and is no longer immobilized within the PTV 100, as will be disclosed herein.

In an embodiment as depicted in FIG. 4C, the PTV 100 is illustrated in the third configuration. In the third configuration, the PTV 100 is configured to allow fluid communication via the one or more ports 122 of the PTV 100. In an embodiment as will be disclosed herein, the PTV may be configured to transition from the second configuration the third configuration upon allowing the pressure applied to the PTV 100 to subside to not more than a second or lower pressure threshold. Additionally, in an embodiment when the PTV is in the third configuration, the sliding sleeve 126 is located (e.g., locked) into a third position within the PTV 100.

Figure 2:
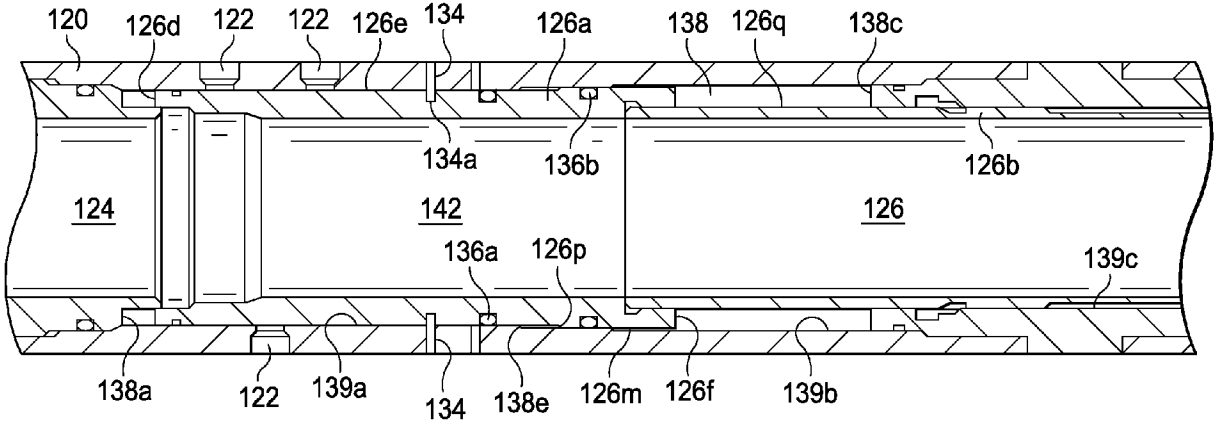
FIG. 2 is a cut-away view of an upper portion of a pressure testing valve.
Figure 3:
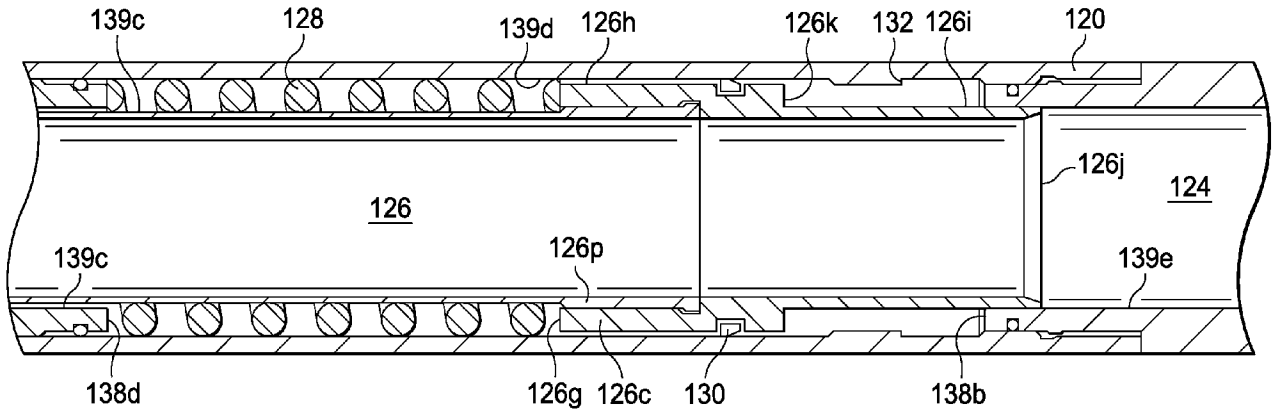
FIG. 3 is a cut-away view of a lower portion of a pressure testing valve.

FIG. 2 and FIG. 3, together, illustrate an embodiment of the PTV 100. In an embodiment the PTV 100 comprises a housing 120. In the embodiment of FIG. 2 and FIG. 3, the housing 120 of the PTV 100 is a generally cylindrical or tubular-like structure. The housing 120 may comprise a unitary structure; alternatively, the housing 120 may be made up of two or more operably connected components (e.g., an upper component, and a lower component). Alternatively, a housing of a PTV 100 may comprise any suitable structure; such suitable structures will be appreciated by those of skill in the art with the aid of this disclosure.

In an embodiment the PTV 100 may be configured for incorporation into the casing string 150, for example, as illustrated by the embodiment of FIG. 1, or alternatively, into any suitable string (e.g., a liner or other tubular). In such an embodiment, the housing 120 may comprise a suitable connection to the casing string 150 (e.g., to a casing string member, such as a casing joint). For example, the housing may comprise internally or externally threaded surfaces. Additional or alternative, suitable connections to a casing string will be known to those of skill in the art.

In the embodiment of FIG. 2 and FIG. 3, the housing 120 generally defines an axial flowbore 124. Referring to FIG. 1, the PTV 100 is incorporated within the casing string 150 such that the axial flowbore 124 of the PTV 100 is in fluid communication with the axial flowbore 115 of the casing string 150. For example, a fluid may be communicated between the axial flowbore 115 of the casing string 150 and the axial flowbore 124 of the PTV 100.

In the embodiment of FIG. 2, the housing 120 comprises one or more ports 122. In this embodiment, the ports 122 extend radially outward from and/or inward towards the axial flowbore 124. As such, these ports 122 may provide a route of fluid communication from the axial flowbore 124 to an exterior of the housing 120 when the PTV 100 is so-configured. For example, the PTV 100 may be configured such that the ports 122 provide a route of fluid communication between the axial flowbore 124 and the wellbore 114 and/or subterranean formation 102 when the ports 122 are unblocked (e.g., by the sliding sleeve 126, as will be disclosed herein). Alternatively, the PTV 100 may be configured such that no fluid will be communicated via the ports 122 between the axial flowbore 124 and the wellbore 114 and/or the subterranean formation 102 when the ports 122 are blocked (e.g., by the sliding sleeve 126, as will be disclosed herein).

In the embodiment of FIG. 2 and FIG. 3, the housing 120 comprises a recess 138. In the embodiment of FIG. 2 and FIG. 3, the recess 138 is generally defined by a first bore surface 139*a*, a second bore surface 139*b*, a third bore surface 139*c*, and a fourth bore surface 139*d*. In this embodiment, the first bore surface 139*a* generally comprises a cylindrical surface spanning between an upper shoulder 138*a* and a first medial shoulder 138*e*, the second bore surface 139*b* generally comprises a cylindrical surface spanning between the first medial shoulder 138*e* and a second medial shoulder 138*c*, the third bore surface 139*c* generally comprises a cylindrical surface spanning between the second medial shoulder 138*c* and a third medial shoulder 138*d*, and the fourth bore surface 139*d* generally comprises a cylindrical surface spanning between the third medial shoulder 138*d* and a lower shoulder 138*b*.

In an embodiment, the first bore surface 139*a* may be characterized as having a diameter less than the diameter of the second bore surface 139*b*. Also, in an embodiment the third bore surface 139*c* may be characterized as having a diameter less than either the diameter of the first bore surface 139*a* or the diameter of the second bore surface 139*b*. Also, in an embodiment, the fourth bore surface 139*d* may be characterized as having a diameter greater than the diameter of the third bore surface 139*c*.

Referring to FIG. 2 and FIG. 3, the sliding sleeve 126 generally comprises a cylindrical or tubular structure comprising an axial flowbore extending there-through. In the embodiment of FIG. 2 and FIG. 3, the sliding sleeve 126 generally comprises a first sleeve segment 126*a*, a second sleeve segment 126*b*, and a third sleeve segment 126*c*. In such an embodiment, the first sleeve segment 126*a*, the second sleeve segment 126*b*, and the third sleeve segment 126*c* are coupled together by any suitable methods as would be known by those of skill in the art (e.g., by a threaded connection). Alternatively, the sliding sleeve 126 may comprise a unitary structure (e.g., a single solid piece).

In an embodiment, the sliding sleeve may comprise one or more of shoulders or the like, generally defining one or more outer cylindrical surfaces of various diameters. Referring to FIG. 2 and FIG. 3, the sliding sleeve 126 comprises an upper surface 126*d*, a first medial shoulder 126*p*, a first outer cylindrical bore face 126*e* extending between the upper surface 126*d* and the first medial shoulder 126*p*, a second medial shoulder 126*f*, and a second outer cylindrical bore surface 126*m*. In an embodiment, the first outer cylindrical bore surface 126*e* may be characterized as having a diameter less than the diameter of the second outer cylindrical bore surface 126*m*. Further, the sliding sleeve 126 may comprise a third medial shoulder 126*g* and a third outer cylindrical bore surface 126*q* extending between the a second medial shoulder 126*f* and the third medial shoulder 126*g*. In an embodiment, the third outer cylindrical bore surface may be characterized as having a diameter less than the diameter of either of the first or the second outer bore surfaces, 126*e* and 126*m*. Further still, the sliding sleeve 126 may comprise a fourth medial shoulder 126*k* and a fourth outer cylindrical bore surface 126*h* extending between the third medial shoulder 126*g* and the fourth medial shoulder 126*k*. In an embodiment, the fourth outer cylindrical surface 126*h* may be characterized as having a diameter greater than the diameter of the third outer cylindrical surface 126*q*. Still further, the sliding sleeve 126 may comprise a lower surface 126*j* and a fifth outer cylindrical surface 126*i* extending between the fourth medial shoulder 126*k* and the lower surface 126*j*. In an embodiment, the fifth outer cylindrical surface 126*i* may be characterized as having a diameter less than the diameter of the fourth outer cylindrical surface 126*h*.

In an embodiment, the sliding sleeve 126 may be slidably and concentrically positioned within the housing. For example, in the embodiment of FIGS. 2 and 3, at least a portion of the first cylindrical bore face 126*e* of the sliding sleeve 126 may be slidably fitted against at least a portion of the first bore surface 139*a* of the recess 138. Further, at least a portion of the second outer cylindrical bore face 126*m* of the sliding sleeve 126 may be slidably able fitted against at least a portion of the second bore surface 139*b* of the recess 138. Further still, at least a portion of the third outer cylindrical bore face 126*q* of the sliding sleeve 126 may be slidably fitted against at least a portion of the third bore surface 139*c* of the recess 138. Further still, at least a portion of the fourth outer bore face 126*h* of the sliding sleeve 126 may be slidably fitted against at least a portion of the fourth bore surface 139*d* of the sliding sleeve 138. Further still, at least a portion of the fifth outer cylindrical bore surface 126*i* may be slidably fitted against at least a portion of a fifth bore surface 139*e* defining the axial flowbore 124.

In an embodiment, one or more of the interfaces between the sliding sleeve 126 and the recess 138 may be fluid-tight and/or substantially fluid-tight. For example, in an embodiment, the recess 138 and/or the sliding sleeve 126 may comprise one or more suitable seals at such an interface, for example, for the purpose of prohibiting or restricting fluid movement via such an interface. Suitable seals include but are not limited to a T-seal, an O-ring, a gasket, or combinations thereof. In the embodiment of FIGS. 2 and 3, the PTV 100 comprises a fluid seal 136*a* (e.g., one or more O-rings or the like) at the interface between the first cylindrical bore face 126*e* of the sliding sleeve 126 and the first bore surface 139*a* of the recess 138 and a fluid seal 136*b* at and/or proximate to the interface between the second outer cylindrical bore face 126*m* of the sliding sleeve 126 and the second bore surface 139*b* of the recess 138.

In an embodiment, the sliding sleeve 126 may be movable, with respect to the housing 120, from a first position to a second position and from the second to a third position with respect to the housing 120.

In an embodiment, the sliding sleeve 126 may be positioned so as to allow or disallow fluid communication via the one or more ports 122 between the axial flowbore 124 of the housing 120 and the exterior of the housing 120, dependent upon the position of the sliding sleeve 126 relative to the housing 120. Referring to FIG. 4A, the sliding sleeve 126 is illustrated in the first position. In the first position, the sliding sleeve 126 blocks the ports 122 of the housing 120 and, thereby, restricts fluid communication via the ports 122. As noted above, when the sliding sleeve 126 is in the first position, the PTV 100 may be in the first configuration. Referring to FIG. 4B, the sliding sleeve 126 is illustrated in the second position. In the second position, the sliding sleeve 126 blocks the ports 122 of the housing 120 and, thereby, restricts fluid communication via the ports 122. Alternatively, referring to FIG. 4C, the sliding sleeve 126 is illustrated in the third position. In the third position, the sliding sleeve 126 does not block or obstruct the ports 122 of the housing 120 and, thereby allows fluid communication via the ports 122.

In an embodiment, the sliding sleeve 126 may be configured to be selectively transitioned from the first position to the second position and/or from the second position to the third position.

For example, in an embodiment the sliding sleeve 126 may be configured to transition from the first position to the second position upon the application of a hydraulic pressure of at least a first threshold to the axial flowbore 124. In such an embodiment, the sliding sleeve 126 may comprise a differential in the surface area of the upward-facing surfaces which are fluidicly exposed to the axial flowbore 124 and the surface area of the downward-facing surfaces which are fluidicly exposed to the axial flowbore 124. For example, in the embodiment of FIGS. 2 and 3, the surface area of the surfaces of the sliding sleeve 126 which will apply a force (e.g., a hydraulic force) in the direction toward the second position (e.g., an upward force) may be greater than surface area of the surfaces of the sliding sleeve 126 which will apply a force (e.g., a hydraulic force) in the direction away from the second position. For example, in the embodiment of FIGS. 2 and 3 and not intending to be bound by theory, because the interface between the first cylindrical bore face 126*e* of the sliding sleeve 126 and the first bore surface 139*a* of the recess 138 and the interface between the second outer cylindrical bore face 126*m* of the sliding sleeve 126 and the second bore surface 139*b* of the recess 138, as disclosed above, are fluidicly sealed (e.g., by fluid seals 136*a* and 136*b*), there is a resulting chamber 142 which is unexposed to hydraulic fluid pressures applied to the axial flowbore, thereby resulting in such a differential in the force applied to the sliding sleeve in the direction toward the second position (e.g., an upward force) and the force applied to the sliding sleeve in the direction away from the second position (e.g., a downward force). For example, the first medial shoulder 126*p* of the sliding sleeve 126 (e.g., which is within the chamber 142) may be unexposed to the axial flowbore 124 while all other faces capable of applying a force are exposed. In an additional or alternative embodiment, a PTV like PTV 100 may further comprise one or more additional chambers (e.g., similar to chamber 142) providing such a differential in the force applied to the sliding sleeve in the direction toward the second position (e.g., an upward force) and the force applied to the sliding sleeve in the direction away from the second position (e.g., a downward force).

Also, in an embodiment the sliding sleeve may be configured to be transitioned from the second position to the third position via the operation of a biasing member. For example, in the embodiment of FIGS. 2 and 3, the PTV 100 comprises a biasing member 128 (e.g., a biasing spring) configured to apply a biasing force to the sliding sleeve 126 in the direction of the third position. Examples of a suitable biasing member include, but are not limited to, a spring, a pneumatic device, a compressed fluid device, or combinations thereof.

In an embodiment, the sliding sleeve 126 may be retained in the first position, the second position, the third position, or combinations thereof by a suitable retaining mechanism.

For example, in the embodiment of FIG. 4A, the sliding sleeve 126 may be held in the first position by one or more shear pins 134. Such shear pins 134 may extend between the housing 120 and the sliding sleeve 126. The shear pin 134 may be inserted or positioned within a suitable borehole in the housing 120 and the borehole 134*a* in the sliding sleeve 126. As will be appreciated by one of skill in the art, the shear pin 134 may be sized to shear or break upon the application of a desired magnitude of force (e.g., force resulting from the application of a hydraulic fluid pressure, such as a pressure test) to the sliding sleeve 126, as will be disclosed herein. In an alternative embodiment, the sliding sleeve 126 may be held in the first position by any suitable frangible member, such as a shear ring or the like.

Also, in the embodiment of FIG. 4C, the sliding sleeve 126 may be retained in the third position by a locking member 130 (e.g., a snap-ring, a C-ring, a biased pin, ratchet teeth, or combinations thereof). In such an embodiment, the snap-ring (or the like) may be carried in a suitable slot, groove, channel, bore, or recess in the sliding sleeve, alternatively, in the housing, and may expand into and be received by a suitable slot groove, channel, bore, or recess in the housing, or, alternatively, in the sliding sleeve. For example, in the embodiment of FIG. 4C, the locking member may be carried within a groove or channel within the sliding sleeve 126 and may expand into a locking groove 132 within the housing 120.

In an embodiment, a wellbore servicing method utilizing the PTV 100 and/or system comprising a PTV 100 is disclosed herein. In an embodiment, a wellbore servicing method may generally comprise the steps of positioning the casing string 150 comprising a PTV 100 within a wellbore 114 that penetrates the subterranean formation 102, applying a fluid pressure of at least an upper threshold within the casing string 150, and reducing the fluid pressure within the casing string 150. In an additional embodiment, a wellbore servicing method may further comprise one or more of the steps of allowing fluid to flow out of the casing string 150, communicating an obturating member (e.g., a ball or dart) via the casing string, actuating a wellbore servicing tool (e.g., a wellbore stimulation tool), stimulating a formation (e.g., fracturing, perforating, acidizing, or the like), and/or producing a formation fluid from the formation.

Referring to FIG. 1, in an embodiment the wellbore servicing method comprises positioning or "running in" a casing string 150 comprising the PTV 100, for example, within a wellbore. In an embodiment, for example, as shown in FIG. 1, the PTV 100 may be integrated within a casing string 150, for example, such that the PTV 100 and the casing string 150 comprise a common axial flowbore. Thus, a fluid introduced into the casing string 150 will be communicated to the PTV 100.

In the embodiment, the PTV 100 is introduced and/or positioned within a wellbore 114 (e.g., incorporated within the casing string 150) in a first configuration, for example, as shown in FIG. 4A. As disclosed herein, in the first configuration, the sliding sleeve 126 is held in the first position by at least one shear pin 134, thereby blocking fluid communication via the ports 122 of the housing 120. Also, the biasing member (e.g., spring) 128 is at least partially compressed and applies a force (e.g., a downward force) to the lower medial face 126*g* of the sliding sleeve 126 in the direction of the third position.

In an embodiment, positioning the PTV 100 may comprise securing the casing string with respect to the formation. For example, in the embodiment of FIG. 1, positioning the casing string 150 having the PTV 100 incorporated therein may comprise cementing (so as to provide a cement sheath 116) the casing string 150 and/or deploying one or more packers (such as packers 170) at a given or desirable depth within a wellbore 114.

In an embodiment, the wellbore servicing method comprises applying a hydraulic fluid pressure within the casing string 150 by pumping a fluid into the casing via one or more typically located at the surface, such that the pressure within the casing string 150 reaches an upper threshold. In an embodiment, such an application of pressure to the casing string 150 may comprise performing a pressure test. For example, during the performance of such a pressure test, a pressure, for example, of at least an upper magnitude, may be applied to the casing string 150 for a given duration. Such a pressure test may be employed to assess the integrity of the casing string 150 and/or components incorporated therein.

In an embodiment, the application of such a hydraulic fluid pressure may be effective to transition the sliding sleeve from the first position to the second position. For example, the hydraulic fluid pressure may be applied through the axial flowbore 124, including to the sliding sleeve 126 of the PTV 100. As disclosed herein, the application of a fluid pressure to the PTV 100 may yield a force in the direction of the second position, for example, because of the differential between the force applied to the sliding sleeve in the direction toward the second position (e.g., an upward force) and the force applied to the sliding sleeve in the direction away from the second position (e.g., a downward force), for example, as provided by chamber 142.

In an embodiment, the hydraulic fluid pressure may be of a magnitude sufficient to exert a force in the direction of the second position sufficient to further compress the biasing member 128 and to shear the one or more shear pins 134, thereby causing the sliding sleeve 126 to move relative to the housing 120 in the direction of the first position, thereby transitioning the sliding sleeve 126 from the first position to the second position. In an embodiment, the sliding sleeve may continue to move in the direction of the second position until the upper shoulder face 126*d* of the sliding sleeve 126 contacts and/or abuts the upper shoulder 138*a* of the recess 138, thereby prohibiting the sliding sleeve 126 from continuing to slide.

In an embodiment, the upper threshold pressure may be at least about 8,000 p.s.i., alternatively, at least about 10,000 p.s.i., alternatively, at least about 12,000 p.s.i., alternatively, at least about 15,000 p.s.i., alternatively, at least about 18,000 p.s.i., alternatively, at least about 20,000 p.s.i., alternatively, any suitable pressure about equal to or less than the pressure at which the casing string 150 is rated.

In an embodiment, the wellbore servicing method comprises allowing the application of pressure within casing string 150 and/or the PTV 100 to fall below a lower threshold. For example, upon completion of the pressure test, for example, having assessed the integrity of the casing string 150, the pressure applied to the casing string 150 maybe allowed to subside. In an embodiment, upon allowing the pressure within the casing string to fall below the lower threshold, the force exerted by the biasing member 128 against the sliding sleeve (e.g., against the third medial face 126*g* in the direction toward the third position is greater than the force due to hydraulic fluid pressure in the direction away from the third position (e.g., the force applied by the biasing spring 128 overcomes any frictional forces and any forces due to hydraulic fluid pressure), thereby causing the sliding sleeve 126 to move in the direction of the third position, for example until the fourth medial shoulder 126*k* comes to rest against the lower shoulder 138*b* of the recess 138, thereby transitioning the sliding sleeve 126 from the second position to the third position.

In an embodiment, the lower threshold may be less than about 6,000 p.s.i., alternatively, less than about 5,000 p.s.i., alternatively, less than about 4,000 p.s.i., alternatively, less than about 3,000 p.s.i., alternatively, less than about 2,000 p.s.i., alternatively, less than about 1,000 p.s.i., alternatively, less than about 500 p.s.i., alternatively, about 0 p.s.i.

In an embodiment, the sliding sleeve slides in the direction of the third position until the locking member 130 (e.g., a snap ring, a lock ring, a ratchet teeth, or the like) of the sliding sleeve 126 engages with an adjacent the locking groove 132 (e.g., groove, a channel, a dog, a catch, or the like) within/along the fourth bore surface 139*d* of the housing 120, thereby preventing or restricting the sliding sleeve 126 from further movement (e.g., from moving out of the third position). Thus, the sliding sleeve 126 is retained in the third position in which the ports 122 of the housing 120 are no longer blocked, thereby allowing fluid communication out of the casing string 150 (e.g., to the wellbore 114, the subterranean formation 102, or both) via the ports 122 of the housing 120.

In an embodiment, following the transitioning of the sliding sleeve 126 into the third position, fluid may be allowed to escape the axial flowbore 115 of the casing 150 and the axial flowbore 124 of the PTV 100 via the ports 122 of the PTV 100. In such an embodiment, allowing fluid to escape from the casing string 150 may allow an obturating member may be introduced within the casing string 150 and communicated therethrough, for example, so as to engage with a suitable obturating member retainer (e.g., a seat) within a wellbore servicing tool incorporated within the casing string 150, thereby allowing actuation of such a wellbore servicing tool (e.g., opening of one or more ports, sliding sleeves, windows, etc., within a fracturing and/or perforating tool) for the performance of a formation servicing operation, for example, a formation stimulation operation, such as a fracturing, perforating, acidizing, or like stimulation operation.

In an embodiment, a wellbore servicing operation may further comprise performing a formation stimulation operation, for example, via one or more wellbore servicing tools incorporated within the casing string. Further still, following the completion of such formation stimulation operations, the wellbore servicing method may further comprise producing a formation fluid (for example, a hydrocarbon, such as oil and/or gas) from the formation via the wellbore.

In an embodiment, a PTV 100, a system comprising a PTV 100, and/or a wellbore servicing method employing such a system and/or a PTV 100, as disclosed herein or in some portion thereof, may be advantageously employed in pressure testing a casing string. For example, in an embodiment, a PTV like PTV 100 enables a casing string to be safely pressurized (e.g., tested) at a desired pressure, but does not require that such test pressure be exceeded following the pressure test in order to transition open a valve. For example, because PTV 100 can be configured to transitioned from the first configuration to the second configuration, as disclosed herein, upon any suitable pressure and because the PTV 100 does not allow fluid communication until the fluid pressure has subsided, a PTV as disclosed herein may be opened without exceeding the maximum value of the pressure test.

As may be appreciated by one of skill in the art, conventional methods of providing fluid communication following a pressure testing a casing string require, following the pressure test, over-pressuring a casing string to shear one or more shear pins and thereby enable fluid communication from the axial flowbore of the casing string to the wellbore formation. As such, conventional tools, systems, and/or methods do not provide a way to ensure the opening of one or more ports without the use of pressure levels which would generally exceed the maximal pressures used during pressure testing. Therefore, the methods disclosed herein provide a means by which pressure testing of a casing string can be performed only requiring pressure levels within the standard pressure testing levels.

ADDITIONAL DISCLOSURE

The following are nonlimiting, specific embodiments in accordance with the present disclosure:

A first embodiment, which is a wellbore servicing system comprising:

- a casing string; and
- a pressure testing valve, the pressure testing valve incorporated within the casing string and comprising:
  - a housing comprising one or more ports and an axial flowbore; and
  - a sliding sleeve, wherein the sliding sleeve is slidably positioned within the housing and transitional from:
    - a first position to a second position, and from the second position to a third position;
    - wherein, when the sliding sleeve is in the first position and the second position, the sliding sleeve blocks a route of fluid communication via the one or more ports and, when the sliding sleeve is in the third position the sliding sleeve does not block the route of fluid communication via the one or more ports;
    - wherein the pressure testing valve is configured such that application of a force in the direction of the second position to the sliding sleeve causes the sliding sleeve to transition from the first position to the second position; and
    - wherein the pressure testing valve is configured such that a reduction of the force in the direction of the second position applied to the sliding sleeve causes the sliding sleeve to transition from the second position to the third position.

A second embodiment, which is the wellbore servicing system of the first embodiment, wherein the pressure test valve is configured such that the application of a fluid pressure of at least an upper threshold to the axial flowbore causes the sliding sleeve to transition from the first position to the second position.

A third embodiment, which is the wellbore servicing system of the second embodiment, wherein the pressure test valve is configured such that a reduction of the fluid pressure to not more than a lower threshold applied to the axial flowbore causes the sliding sleeve to transition from the second position to the third position.

A fourth embodiment, which is the wellbore servicing system of one of the first through the third embodiments, wherein the sliding sleeve is biased in the direction of the third position.

A fifth embodiment, which is the wellbore servicing system of the fourth embodiment, wherein the pressure testing valve comprises a spring, wherein the spring is configured to bias the sliding sleeve towards the third position.

A sixth embodiment, which is the wellbore servicing system of one of the first through the sixth embodiments, wherein the pressure testing valve comprises one or more frangible members.

A seventh embodiment, which is the wellbore servicing system of the sixth embodiment, wherein the one or more frangible members are configured to restrain the sliding sleeve in the first position.

An eighth embodiment, which is the wellbore servicing system of one of the first through the seventh embodiments, wherein the pressure testing valve comprises a locking system comprising a lock and locking groove.

A ninth embodiment, which is the wellbore servicing system of the eighth embodiment, wherein the lock combines with the locking groove to retain the sliding sleeve in the third position.

A tenth embodiment, which is the wellbore servicing system of one of the first through the ninth embodiments, where the pressure testing valve comprises a differential area chamber, wherein the differential area chamber is not fluidicly exposed to the axial flowbore.

An eleventh embodiment, which is the wellbore servicing system of the tenth embodiment, wherein the differential area comprises of one or more o-rings.

A twelfth embodiment, which is the wellbore servicing system of the third embodiment, wherein the upper threshold is at least about 15,000 p.s.i.

A thirteenth embodiment, which is the wellbore servicing system of the third embodiment, wherein the upper threshold is at least about 18,000 p.s.i.

A fourteenth embodiment, which is the wellbore servicing system of the third embodiment, wherein the lower threshold is not more than about 5,000 p.s.i.

A fifteenth embodiment, which is the wellbore servicing system of the third embodiment, wherein the lower threshold is not more than about 4,000 p.s.i.

A sixteenth embodiment, which is a wellbore servicing method comprising:

positioning casing string having a pressure testing valve incorporated therein within a wellbore penetrating the subterranean formation, wherein the pressure testing valve comprises:

a housing comprising one or more ports and an axial flowbore; and a sliding sleeve, wherein the sliding sleeve is slidably positioned within the housing, wherein the sliding sleeve is configured to block a route of fluid communication via one or more ports when the casing string is positioned within the wellbore;

applying a fluid pressure of at least an upper threshold to the axial flowbore, wherein, upon application of the fluid pressure of at least the upper threshold, the sliding sleeve continues to block the route of fluid communication; and reducing the fluid pressure to not more than a lower threshold, wherein, upon reduction of the fluid pressure to not more than the lower threshold, the sliding sleeve allows fluid communication via one or more ports of the housing.

A seventeenth embodiment, which is the method of the sixteenth embodiment, wherein the sliding sleeve is retained in position by one or more shear pins prior to the application of fluid pressure of at least the upper threshold, wherein the application of fluid pressure of at least the upper threshold causes the one or more shear pins to severe, shear, break, disintegrate, or combinations thereof.

An eighteenth embodiment, which is the method of one of the sixteenth through the seventeenth embodiments, wherein the sliding sleeve further comprises a locking system configured to retain the sliding sleeve in position after reduction of the fluid pressure to not more than the lower threshold.

A nineteenth embodiment, which is a wellbore servicing method comprising:

positioning casing string having a pressure testing valve incorporated therein within a wellbore penetrating the subterranean formation;

pressurizing an axial flowbore of the casing string, wherein the pressure within the axial flowbore reaches at least an upper threshold;

maintaining the pressure within the axial flowbore for a predetermined duration;

allowing the pressure within the axial flowbore to subside to not more than a lower threshold, wherein, upon allowing the pressure within the axial flowbore to subside to not more than the lower threshold, the pressure testing valve opens.

A twentieth embodiment, which is the wellbore servicing method of the nineteenth embodiment, wherein the pressure applied to the axial flowbore is less than or equal to about the upper threshold.

A twenty-first embodiment, which is a wellbore servicing method comprising:

pressure testing at a first pressure a tubing string positioned within a wellbore penetrating a subterranean formation;

reducing pressure within the tubing string to a second pressure that is less than the first pressure, wherein the reduction in pressure opens a fluid pathway between an interior of the tubing string and the wellbore; and flowing a fluid down the tubing string, through the fluid pathway, and into the wellbore or subterranean formation.

A twenty-second embodiment, which is the method of the twenty-first embodiment, wherein flowing the fluid down the tubing string further comprises flowing an obturating member down the tubing string, landing the obturating member on a landing structure associated with a wellbore tool, and applying a hydraulic force to the wellbore tool via the landed obturating member to configure the wellbore tool to perform a wellbore service.

A twenty-third embodiment, which is the method of the twenty-second embodiment, wherein the obturating member is a ball or dart, the landing structure is a seat configured to receive the ball or dart, the wellbore servicing tool is a fracturing or perforating tool, and the wellbore service is a fracturing or perforating service.

A twenty-fourth embodiment, which is a wellbore servicing system comprising:

a casing string; and a pressure testing valve, the pressure testing valve incorporated within the casing string and comprising:

a housing comprising one or more ports and an axial flowbore; and a sliding sleeve, wherein the sliding sleeve is slidably positioned within the housing and transitional from:

a first position to a second position, and from the second position to a third position;

wherein, when the sliding sleeve is in the first position and the second position, the sliding sleeve blocks a route of fluid communication via the one or more ports and, when the sliding sleeve is in the third position the sliding sleeve does not block the route of fluid communication via the one or more ports;

wherein the pressure testing valve is configured such that application of a fluid pressure of at least an upper threshold to the axial flowbore causes the sliding sleeve to transition from the first position to the second position; and wherein the pressure testing valve is configured such that a reduction of the fluid pressure to not more than a lower threshold applied to the axial flowbore causes the sliding sleeve to transition from the second position to the third position.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k* (Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing system comprising:

a casing string; and a pressure testing valve, the pressure testing valve incorporated within the casing string and comprising:

a housing comprising one or more ports and an axial flowbore; and a sliding sleeve, wherein the sliding sleeve is slidably positioned within the housing and transitional in a first direction from a first position to a second position, and in a second direction from the second position to a third position;

wherein, when the sliding sleeve is in the first position and the second position, the sliding sleeve blocks a route of fluid communication via the one or more ports and, when the sliding sleeve is in the third position the sliding sleeve does not block the route of fluid communication via the one or more ports;

wherein the pressure testing valve is configured such that application of a force to the sliding sleeve in a first direction causes the sliding sleeve to transition in the first direction from the first position to the second position;

wherein the pressure testing valve is configured to remain in the second position until the force in the first direction is reduced to not more than a lower threshold force; and wherein the pressure testing valve is configured to transition in the second direction from the second position to the third position when the force is reduced to not more than the lower threshold force; and wherein the pressure testing valve comprises a locking system comprising a lock and locking groove; and wherein the lock combines with the locking groove to retain the sliding sleeve in the third position.

2. The wellbore servicing system of claim 1, wherein the pressure test valve is configured such that the application of a fluid pressure of at least an upper threshold to the axial flowbore causes the sliding sleeve to transition from the first position to the second position.

3. The wellbore servicing system of claim 2, wherein the pressure test valve is configured such that a reduction of the fluid pressure to not more than a lower threshold applied to the axial flowbore causes the sliding sleeve to transition from the second position to the third position.

4. The wellbore servicing system of claim 3, wherein the upper threshold is at least about 15,000 p.s.i.

5. The wellbore servicing system of claim 3, wherein the upper threshold is at least about 18,000 p.s.i.

6. The wellbore servicing system of claim 3, wherein the lower threshold is not more than about 5,000 p.s.i.

7. The wellbore servicing system of claim 3, wherein the lower threshold is not more than about 4,000 p.s.i.

8. The wellbore servicing system of claim 1, wherein the sliding sleeve is biased in the direction of the third position.

9. The wellbore servicing system of claim 8, wherein the pressure testing valve comprises a spring, wherein the spring is configured to bias the sliding sleeve towards the third position.

10. The wellbore servicing system of claim 1, wherein the pressure testing valve comprises one or more frangible members.

11. The wellbore servicing system of claim 10, wherein the one or more frangible members are configured to restrain the sliding sleeve in the first position.

12. The wellbore servicing system of claim 1, where the pressure testing valve comprises a differential area chamber, wherein the differential area chamber is not fluidicly exposed to the axial flowbore.

13. The wellbore servicing system of claim 12, wherein the differential area comprises of one or more o-rings.

14. A wellbore servicing method comprising:

positioning casing string having a pressure testing valve incorporated therein within a wellbore penetrating the subterranean formation, wherein the pressure testing valve comprises:

a housing comprising one or more ports and an axial flowbore; and a sliding sleeve, wherein the sliding sleeve is slidably positioned within the housing, wherein the sliding sleeve is configured to block a route of fluid communication via one or more ports when the casing string is positioned within the wellbore;

applying a fluid pressure of at least an upper threshold to the axial flowbore, wherein, upon application of the fluid pressure of at least the upper threshold, the sliding sleeve translates in a first direction and continues to block the route of fluid communication; and reducing the fluid pressure, wherein the sliding sleeve continues to block the route of fluid communication until the fluid pressure is reduced to not more than a lower threshold, and wherein, upon reduction of the fluid pressure to not more than the lower threshold, the sliding sleeve translates in a second direction opposite the first direction and allows fluid communication via one or more ports of the housing; and wherein the pressure testing valve comprises a locking system comprising a lock and locking groove configured to retain the sliding sleeve in the third position.

15. The method of claim 14, wherein the sliding sleeve is retained in position by one or more shear pins prior to the application of fluid pressure of at least the upper threshold, wherein the application of fluid pressure of at least the upper threshold causes the one or more shear pins to severe, shear, break, disintegrate, or combinations thereof.

16. The method of claim 14, wherein the sliding sleeve further comprises a locking system configured to retain the sliding sleeve in position after reduction of the fluid pressure to not more than the lower threshold.

* * * * *